US008245385B2

(12) United States Patent
He et al.

(10) Patent No.: US 8,245,385 B2
(45) Date of Patent: Aug. 21, 2012

(54) APPARATUS AND METHODS FOR AUTOMATIC SHOE COVER STRIPPING

(76) Inventors: Liam Minhai He, Tyngsboro, MA (US); Yi Wang, Montreal (CA); Qiuhong Wang, Tyngsboro, MA (US)

( * ) Notice: Subject to any disclaimer, the term of this patent is extended or adjusted under 35 U.S.C. 154(b) by 865 days.

(21) Appl. No.: 12/283,716

(22) Filed: Sep. 16, 2008

(65) Prior Publication Data

US 2009/0071989 A1 Mar. 19, 2009

Related U.S. Application Data

(60) Provisional application No. 60/993,970, filed on Sep. 17, 2007.

(51) Int. Cl.
*B23P 21/00* (2006.01)

(52) U.S. Cl. ..... 29/701; 29/426.1; 29/426.5; 29/700; 29/711; 29/714; 220/825; 220/661; 220/676; 206/363; 700/95

(58) Field of Classification Search ..... 29/426.1, 29/426.5, 700, 703, 709, 711, 714, 701; 223/111, 223/113; 220/825, 661, 676; 206/363; 700/95
See application file for complete search history.

(56) References Cited

U.S. PATENT DOCUMENTS

2008/0173658 A1* 7/2008 Ronning ..... 220/825
2011/0272440 A1* 11/2011 Heller ..... 223/113
2011/0278332 A1* 11/2011 Heller et al. ..... 223/113

* cited by examiner

*Primary Examiner* — Derris Banks
*Assistant Examiner* — Azm Parvez

(57) ABSTRACT

Protective shoe covers have been widely used in health care setting and some industry environment that require clean room condition. To strip off the disposed shoe covers in a hand-free and automated fashion is very desirable to the users, which provide physical convenience, time saving and economic merits. This disclosed invention provides methods and an automatic system for stripping of disposable shoe cover from user's foot/feet that includes the electro-mechanical complex, a micro control unit and its embedded software programs, control algorithm to guide the execution of the stripping functions in automated and hand-free fashion.

9 Claims, 9 Drawing Sheets

APPARATUS AND METHODS FOR AUTOMATIC SHOE COVER STRIPPING

This application claims the priority of the U.S. Provisional Patent Application of APPL No. 60/993,970, entitled "APPARATUS AND METHODS FOR AUTOMATIC DISPOSABLE SHOE COVER STRIPPING", which was filed on Sep. 17, 2007 by the same inventors.

BACKGROUND OF THE INVENTION

1. Field of Invention

This invention relates to an automated system that to strip the disposable shoe cover(s) from a user's foot/feet. More specifically, the invention relates to the apparatus and methods for stripping of disposable shoe covers from the user's shoes, transferring of disposed shoe covers to the collecting bin and disinfecting of disposed shoe covers in automated fashion.

2. Discussion of the Related Art

Disposable protective shoe covers have been widely used in health care settings such as surgical suites, intensive care units and cardiac catheter laboratories that require sterilization and control of contamination and cross contamination. The shoe covers also have been widely used in some manufacturing environments, including semiconductor and pharmaceutical industries that require "clean rooms" and sterile atmospheres to prevent dust and any other contaminates from human traffic.

However, it is inconvenience and wasteful to exchange disposable shoe cover while a surgeon, or a medical researcher or any individual's hands in sterilized condition, because in order to strip a shoe cover manually it requires an individual to break sterilization, i.e. to remove sterilized gloves, if he/she needs to re-enter the sterilization field or a clean room. This disclosed invention is to present the apparatus and methods that are able to provide automatic and true hands-free stripping of the disposable shoe covers from user's foot/feet, which is desirable to users who need to maintain sterilization for their hands. This novel invention also provides economic value and physical convenience to those people work at sterilization and clean environment.

SUMMARY OF THE INVENTION

The present invention encompasses methods and a system for stripping of disposable shoe covers from an individual user's feet automatically. The automatic shoe cover stripping system includes the micro control unit (MCU) and its embedded software and the control algorithm, the electro-mechanical operational apparatus, physical and biophysical sensors, collecting bin and disinfecting module.

In one embodiment, the present invention includes an electro-mechanical apparatus, which comprises a stripping module, removing module and disinfecting module. The operational steps include generating and applying optimal negative pressure to the suctorial disk, stripping shoe cover from user's foot, rolling over (transferring) to the collecting bin and disinfecting disposed shoe cover.

In another embodiment, the present invention contains the MCU and control algorithm, photo-electrical and position sensors, the electrical circuitry and hardware that receive and process all the input and output information of system that reflects that real-time working status related to the stripping area and user's foot (feet).

In another embodiment, the present invention contains MCU and embedded software to control the electro-mechanical complex or subsystem via the electrical circuitry and hardware to execute the necessary operational instructions and to direct and control the operating modules to perform functions of stripping, removing and disinfecting of the disposed shoe covers from user's shoes. The operational steps include generating and applying optimal negative pressure to the suctorial disk, stripping shoe cover from user's foot, rolling over (transferring) the stripped shoe cover to the collecting bin and disinfecting disposed shoe covers.

In another embodiment, the present invention contains a system including MCU and embedded software to execute operational instructions to guide the electro-mechanical operational apparatus; to receive real-time input singles from the thermal-infrared sensors and position sensors, to send a real time operational instructions to assure operational and safety control, to display digital media of the working status as well as other functions, i.e. alarm, voice activation, remote control, keypad and other command input means.

In another embodiment, the present invention includes various sensors to collect physical and biophysical information i.e. position, location and blockage of the working space that users foot will be inserted in order to ensure proper operation and safety features.

BRIEF DESCRIPTION OF DRAWINGS

The accompanying drawings not intended to be drawn to scale. In the drawings, like components that are illustrated in various figures are represented by a like numeral. For purposed of clarity, not every component may be labeled in every drawing. In the drawings:

FIG. 3 B is a logic control flow chart that describes the methods and operational steps of automatic shoe stripping system. At normal condition, when the system power turns on, it starts the system initiation process includes turning on the motor 14 and the negative pressure generator 15 to prepare negative pressure to perform designated functions. The system also starts the detecting process: the emission component 51 of the sensors sends out signal, if the stripping space is empty, the receiving sensor 52 sends out Yes signal to the MCU, the system is in ready status. When a user's foot steps in the stripping area, the receiving sensor 52 send No signal to the MCU, the system starts the stripping and other process under guidance of operational commands from the MCU. The commands from the MCU to open the valve 12 to transmit the negative pressure the suctorial disk 11 via pipe 13 to cause the disposable shoe cover to be stripped off when a user move his/or her foot away for the stripping position. If the sensors 52 sense the user's foot has moved away from the stripping area, which send out Yes single to the MCU that to pause the negative pressure generator 15 and shut off the electromagnetic valve 12. Consequently, the MCU sends out the commands to turn on the motor 27 of removing module to start the removing procedure that to transfer the disposed shoe covers to the collecting bin 53 via the pair roller 21, 22. The system therefore is set ready for the next working cycle.

DESCRIPTION OF THE INVENTION

Figure 1A:
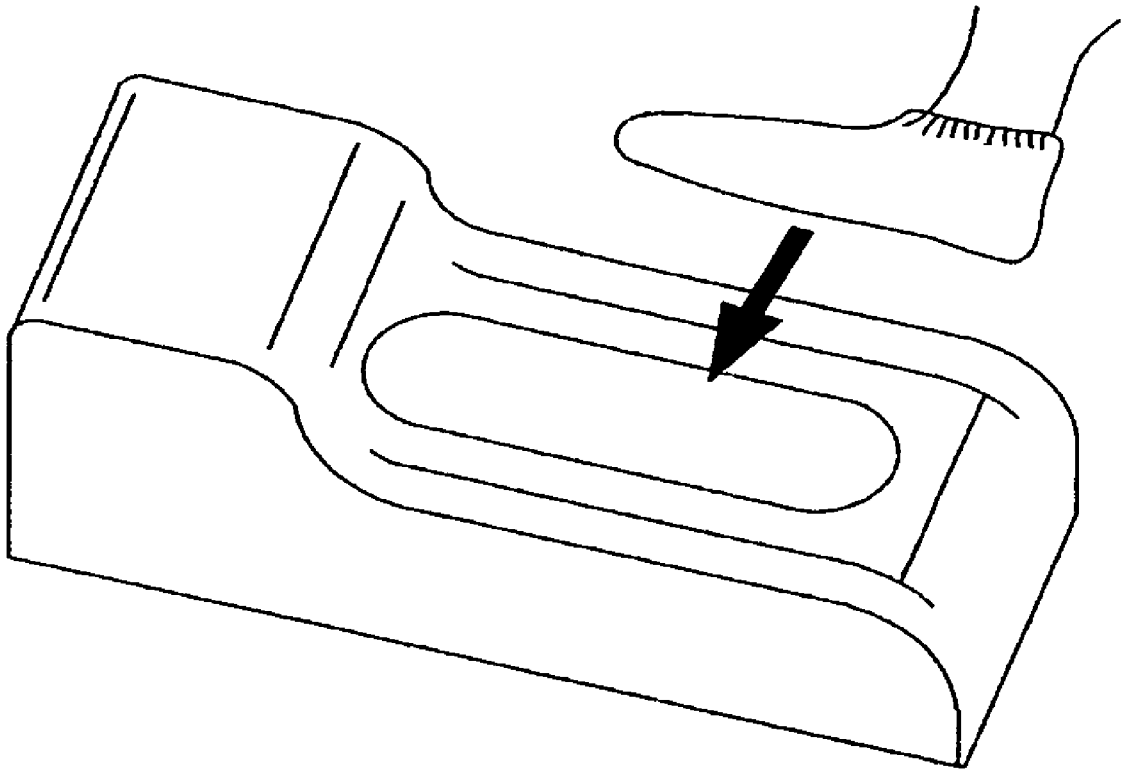
FIG. 1A is an outside view of the shoe cover stripping system, which illustrates the opening of the stripping position that negative pressure will applied to user's foot when a user's foot enters into the stripping position.

This present invention provides apparatus and methods to automatically strip the shoe covers from the user's foot/feet. The automatic system saves time and materials e.g. surgical gloves for the aforementioned process. It also provides physical convenience for users who wear disposable shoe covers getting out and re-entering the place that sterilization and sanitation conditions are required. It also provides physical convenience to those users who wants to dispose the shoe covers in timely and hand-free fashion.

Specifically, the present invention encompasses a system that is able to automatically strip the disposable shoe covers directly from a user's shoes (feet). This present invention provides method and means that protects disposable shoe users from contamination and cross-contamination from human and animal subjects and enhances laboratory hygiene and neatness of the changing area of the medical/biomedical laboratories, industry clean rooms.

In one embodiment, the system comprises the micro control unit (MCU), its embedded software and the control algorithm, executable control instruction, the electrical circuitry and hardware, the electro-mechanical operational apparatus and physical and biophysical sensors to perform stripping, removing and disinfecting functions.

In another embodiment, the present invention comprises the stripping module that generates and applies negative suction to strip the shoe cover(s) from user's foot/feet by the motor 14, the negative pressure generator 15 and the suctorial disk 11.

In another embodiment, the present invention comprises the removing module via the electro-mechanical apparatus that includes paired triangle roller 21 and 22, the gears 23 and 25 and motor 27 to transfer disposed shoe covers into the collecting bin.

In another embodiment, the present invention includes collecting bin/bag to collect disposed shoe covers and then to remove them from the system after being disinfected.

In another embodiment, the system includes a disinfecting module to automatically apply disinfecting materials to the disposed shoe covers in the collecting bin for sanitation purpose to prevent contamination and cross contamination to users, or patients or experimental animal subjects.

In another embodiment, the present invention includes MCU and embedded software to perform real-time counting of the disposed shoe covers enter or are in the collecting container and to initiate disinfecting function and removal of disposed shoe covers.

Figure 1B:
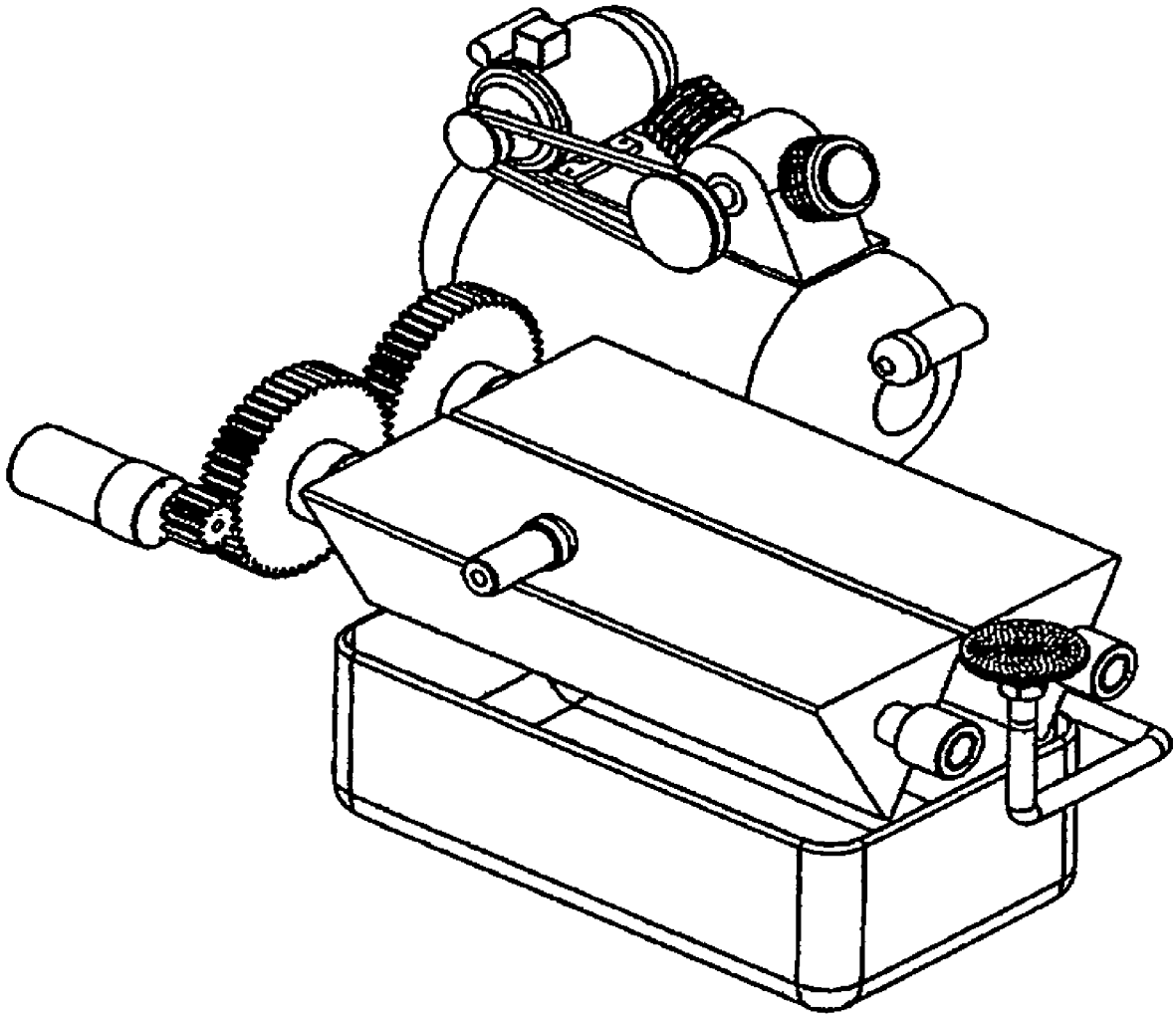
FIG. 1B illustrates the over view of internal structure of the automatic shoe cover stripping system, which includes the stripping module, removal module, collecting bin.
Figure 2:
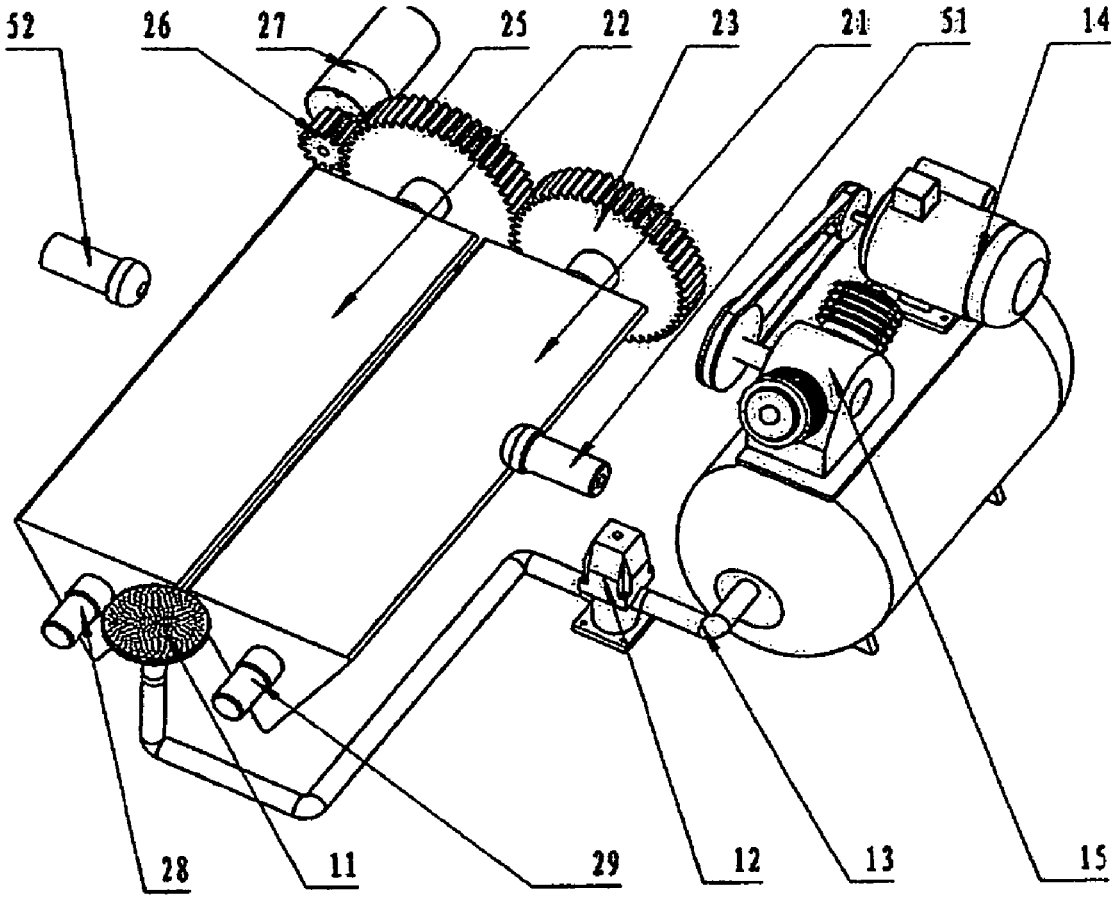
FIG. 2 illustrates a structural overview of the electro-mechanical assembly of shoe cover stripper, which includes stripping module and the shoe cover removing module, infrared sensing components 51, 52. The stripping module contains suctorial disk 11, the electromagnetic valve (solenoid) 12, negative pressure pipe 13, the negative pressure motor 14 and negative pressure generator 15. The removal module contains components of a set of triangle paired roller 21 and 22, a set of gears 23, 25 and the removal driving motor 27.

Reference in now made to FIG. 1 and FIG. 2, which illustrates the overview from outside and inside of the automatic shoe cover stripping system. The FIG. 2 illustrates the structural view of the electro-mechanical complex that executes the shoe cover stripping functions. As soon as the system power is turned on, the MCU starts the system initiation process: the sensor(s) detect if there is a foot at the stripping area and send signals to the MCU; and MCU sends out its command to turn on the motor 14 and the negative pressure generator 15 to prepare negative pressure and get ready to perform stripping and other functions. When a user's foot with disposable shoe cover on enters the stripping area of the shoe cover striper, the MCU processes the input signals and sends out the control commands to open the electromagnetic valve 12 via negative pressure pipe 13 that is connected to the suctorial disk 11. When negative pressure is applied to the shoe cover on a user's foot, the suctorial disk 11 will tightly suck on the rare part of the user's shoe cover. As the user's foot lifts and moves away from the stripping area, the shoe cover is stripped off (pull out from the user's shoe). After the shoe cover is stripped, the electromagnetic valve 12 will be turned off so that the shoe cover will be released from the suctorial disk 11. Then the removing module will be activated to transfer the stripped shoe cover to the collecting bin 53 for temporally storage and disinfection.

Figure 4:
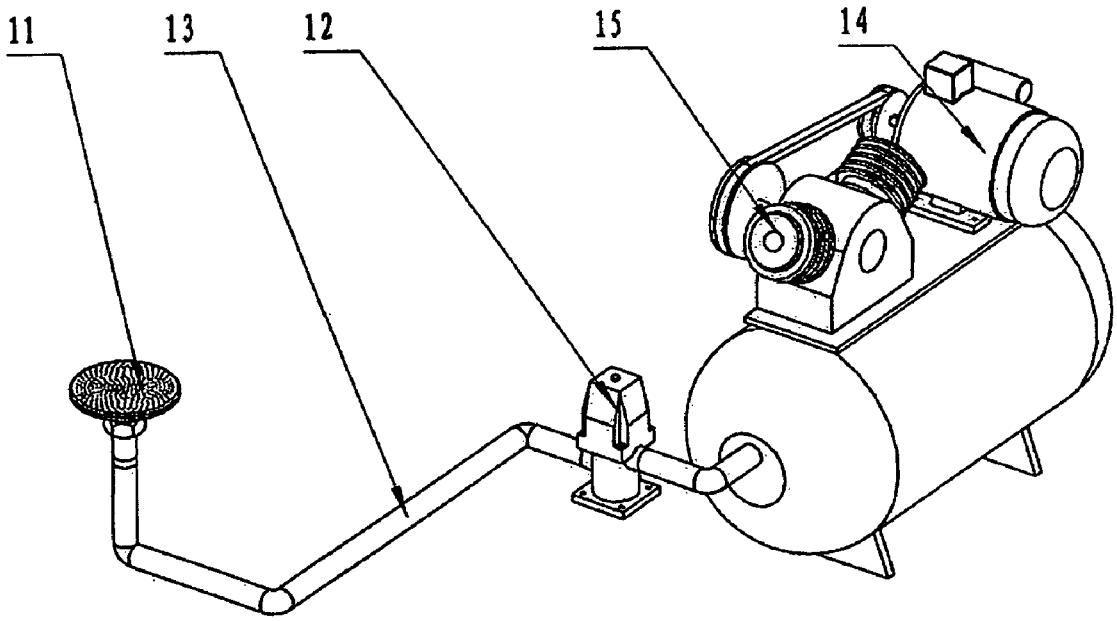
FIG. 4 is a drawing that illustrates the shoe cover stripping module, which includes the negative pressure outlet and suctorial disk 11, electromagnetic valve (solenoid) 12, negative pressure pipe 13, the negative pressure motor 14 and negative pressure generator 15.

As further illustrated in the FIGS. 2 and 4, the stripper module of the automatic shoe cover stripping system includes the outlet of negative pressure, suctorial disk 11, the electromagnetic valve 12 and negative pressure pipe 13, the motor 14 and negative pressure generator 15. When a user's foot steps in the stripping area, the receiving sensors send signal to MCU. MCU sends out the commands to initiates the system and starts the stripping process which to turn on the motor 14 and the negative pressure generator 15 and to open the electro-magnetic valve 12. The negative pressure will apply to the suctorial disk 11 via the negative pressure pipe 13. When the negative pressure applies to shoe cover, the suctorial disk 11 will tightly suck on the rare part of the user's shoe cover. When the user's foot lifts and moves away from the stripping area, the shoe cover is pulled out from the user's shoe, due to the negative pressure applied to the rare part of shoe cover via the suctorial disk 11.

Figure 3A:
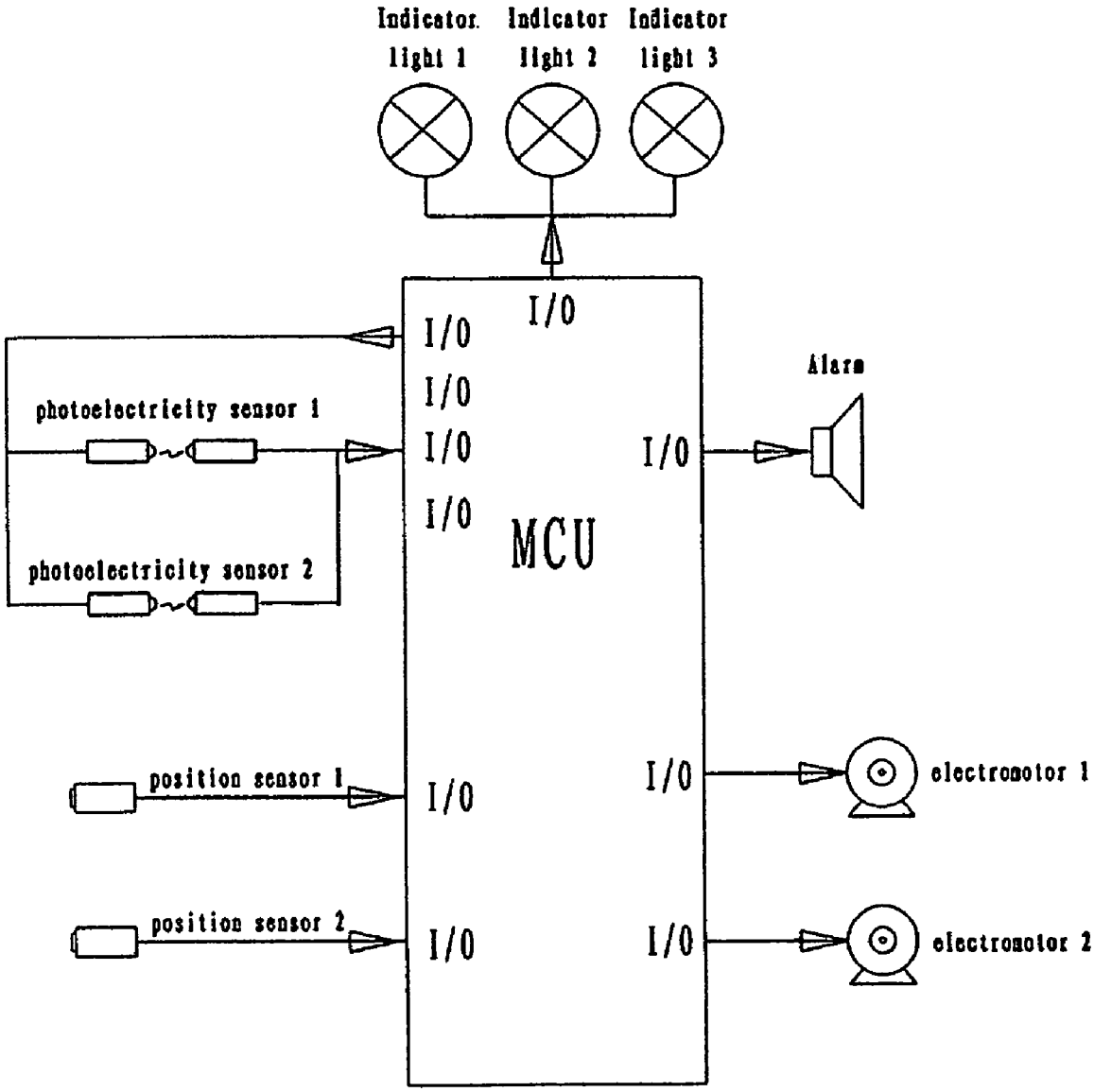
FIG. 3 A illustrates the control circuit architecture, the micro control unit (MCU) and electrical circuitry and hardware that include electrical motors 14 and 27, negative pressure generator 15, solenoid 12, control board, control power supply, indicator lights and alarm.
Figure 3B:
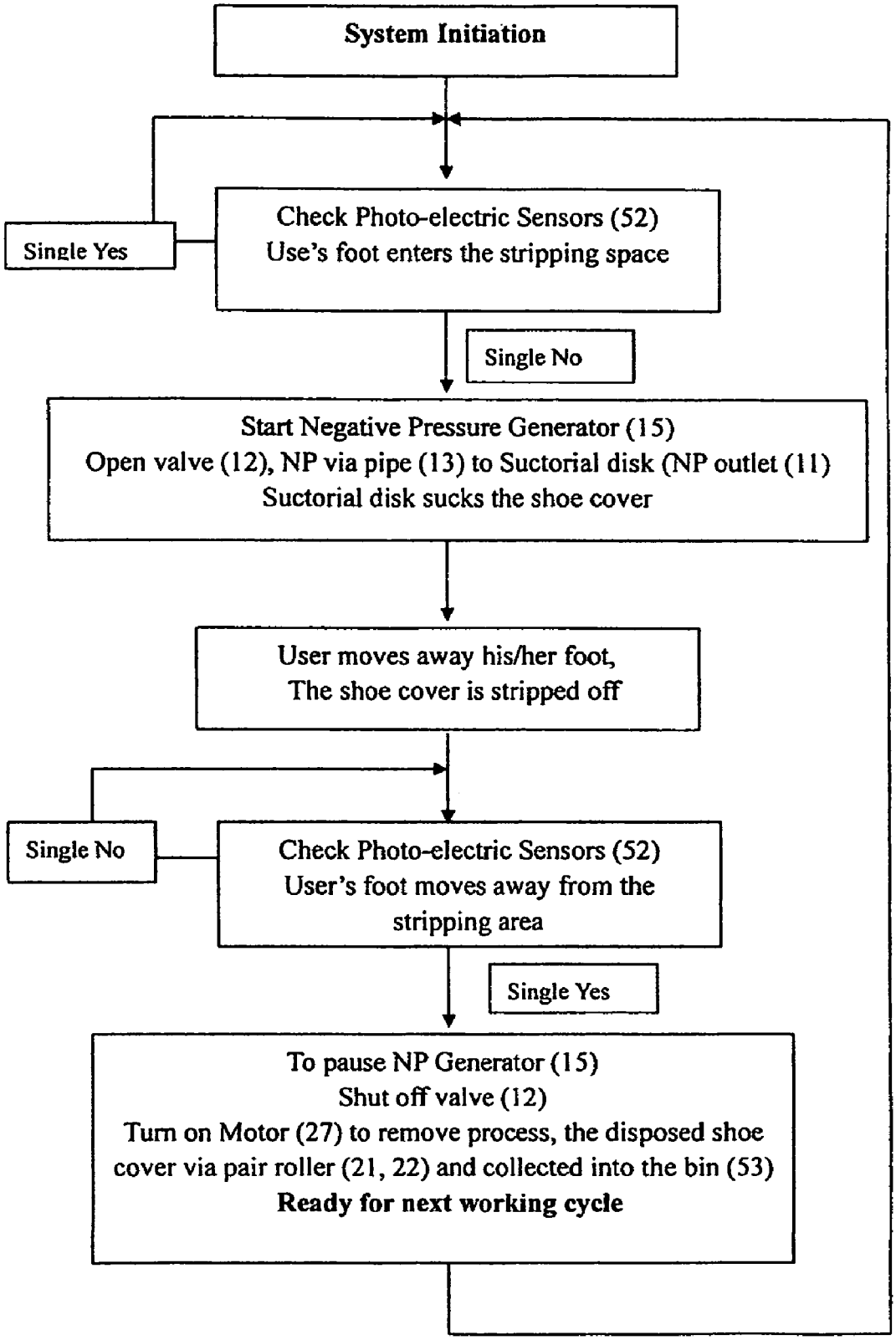
Figure 5:
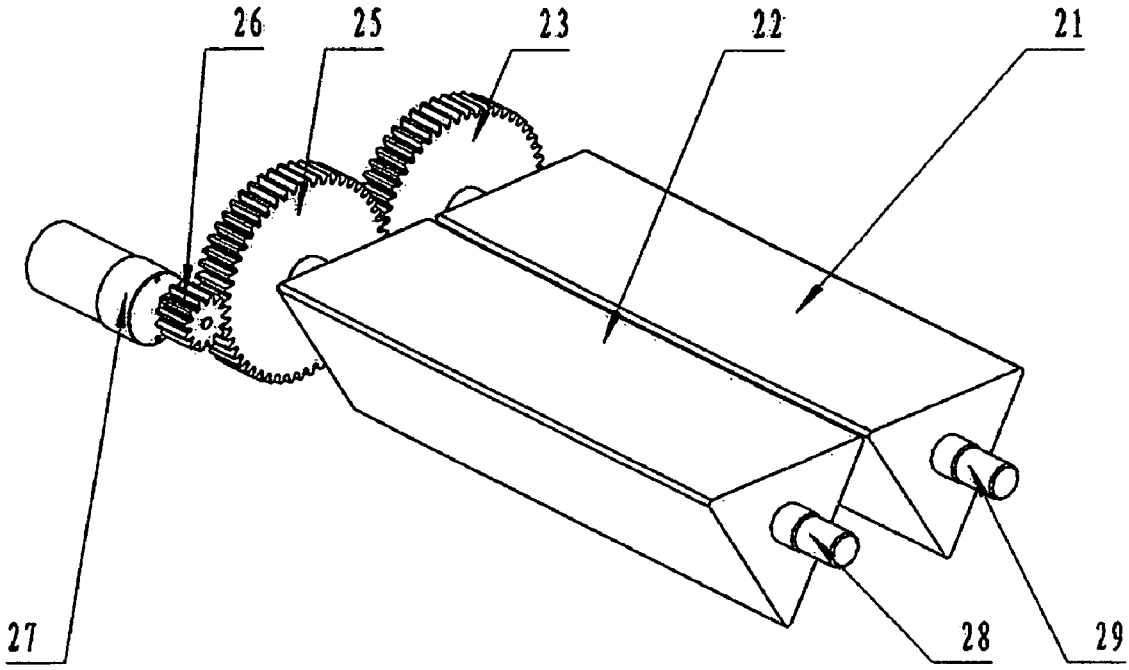
FIG. 5 is a schematic that illustrates the shoe cover-removing module that includes triangle paired roller 21 and 22, the gears 23 and 25, motor 27 and the gear that drives triangle paired roller (motor side) 26. During the removing process, the paired-roller moves in opposite directions and then transfers the disposed shoe cover from the suctorial disk to the collecting bin under the instructions from the MCU.
Figure 6:
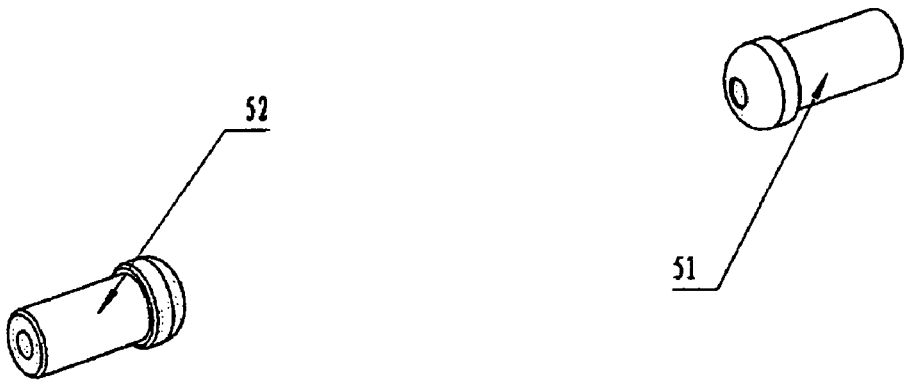
FIG. 6 illustrates the infrared sensors, which includes the infrared emission device 51 and infrared receiving device 52.

The shoe cover removal process is illustrated in FIGS. 2, 3B and 5. The removal module includes major parts of paired triangle roller 21 and 22, the gears 23 and 25 and the driving motor 27. The removal module is designated to remove and transfer the disposed shoe cover(s) that stripped from the user's shoe and disposed it/them into a disposal collection container. The procedure is described as follows: after the disposed shoe cover is stripped from the user's shoe and user's foot moves away from the shoe cover stripper, the infrared sensor(s) or other sensors send signals to MCU, when the MCU receives the signals, it processes the input signals and then sends out the commands to close an electromagnetic valves (solenoids) 12 that is adjacent to the pair-roller to release the negative pressure. Then the pair-roller roller moves in opposite directions and transfers the disposed shoe cover from the suctorial disk to the collecting bin guided by the instructions from the MCU.

Figure 7:
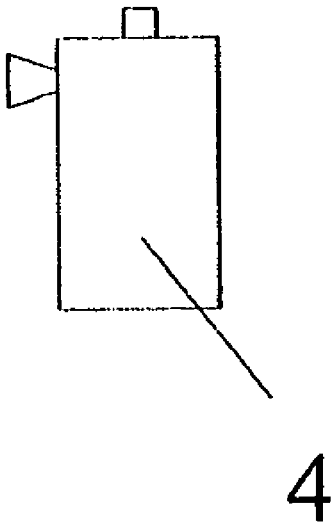
FIG. 7 illustrates the disinfecting module which includes sensors and automatic spray apparatus, which includes disinfecting spray device 4.
Figure 7:
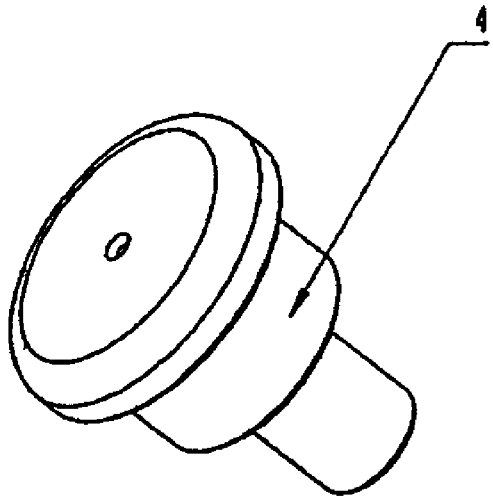
Figure 8:
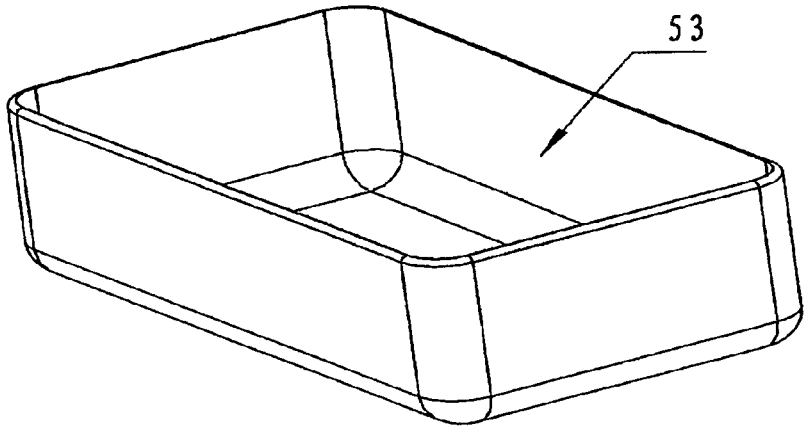
FIG. 8 is a schematic that illustrates the disposed shoe cover collecting bin 53 of the automatic shoe cover stripping system.

Reference in now made to FIGS. 2, 7 and 8, which illustrate the disposed shoe cover collecting bin 53 and spray head 4 of the disinfecting module. The collecting bin 53 is located on the lower position of said shoe cover stripper, for the purpose of temperately collection and disinfecting of disposed shoe covers. When the disposed shoe cover stripped off from the user's shoe and transferred and disposed into the collecting bin, MCU sends commands to the spray head 4 to spray disinfectant on to the collected disposed shoe covers to prevent human and experimental animal subjects from contamination and cross contamination. When the disposable collecting bin is full, the sensor(s) send out signal to MCU that process the incoming signal and set off alarm with audio or voice reminder. The full collecting bin of disposed shoe covers therefore can be emptied or/and replaced.

Reference is now made to FIG. 3 A that represents the control module of the system that contains the MCU, the electrical motors, the photoelectric sensors, position sensors, alarm, indicator lights, power supply to operate motors, solenoid and control circuitry boards, etc. The system contains the MCU and embedded software to control the electro-mechanical complex performing functions of shoe cover stripping, removing, collecting, disinfecting. The controlling functions include but not limited to initiating of the system, generating and directing of negative pressure, opening and closing the control valves 12, controlling of the motor that drives the pair-roller 21, 22 of the removal module and controlling of the spray process, and providing alarm and voice reminder when operation error occur or the disposable collecting bin 53 is full.

FIG. 3 B is the system logic control flow chart that briefly describes the operational steps. In brief, at normal condition, when the system power turns on, the MCU starts system initiation procedures includes turning on the motor 14 to drive the negative pressure generator 15 to get ready for system to perform the stripping, removing and disinfecting functions. The emission component 51 of the sensors send out infrared ray, if the stripping space is empty (there is no foot and object in the stripping area), the receiving sensor 52 sends out Yes signal to the MCU, the system stays at ready status. When a user's foot steps in the stripping area, the receiving sensor 52 send No signal to the MCU, the system initiates the stripping and other processes under guidance of operational commands from the MCU. The stripping process starts with opening of the electromagnetic valve 12 to transmit the negative pressure the suctorial disk 11 via pipe 13 to cause the disposable shoe cover to be stripped of when a user move his/or her foot away for the stripping position. If the sensors 52 sense the user's foot has moved away from the stripping area, which send out Yes single to the MCU that to pause the negative pressure generator 15 and shut off the electromagnetic valve 12. Consequently, the MCU sends out the commands to turn on the motor 27 of removing module to start the removing procedure that to transfer the disposed shoe covers to the collecting bin 53 via the pair roller 21, 22. The system therefore is set ready for the next working cycle.

Having thus described several aspects of at least one embodiment of this invention, it is to be appreciated that various alterations, modifications, and improvements will readily occur to those skilled in the art. Such alteration, modifications and improvements are intended to be part of this disclosure and are intended to be within the spirit and scope of the invention. Accordingly, the foregoing description and drawings are by way of example only.

The invention claimed is:

1. An automatic shoe cover stripping system, comprising an apparatus having an opening for receiving a user's shoe having a shoe cover and an electromechanical subsystem to operate the apparatus for stripping said shoe cover from said user's shoe, wherein said electromechanical subsystem includes a shoe cover stripping module, a shoe cover removal module that is connected to said shoe cover stripping module, a shoe cover collecting bin for disposed shoe covers, wherein said collecting bin is connected to said shoe cover removal module, a disinfecting module that is connected to said collecting bin, all modules being under guidance of commands from a micro control unit (MCU) that constitutes a part of the electromechanical subsystem, said MCU comprising embedded software programs having a control algorithm that commands functions for the automatic shoe cover stripping system, and a set of physical and biophysical sensors to provide operational and safety guidance, wherein said sensors include position sensors and thermal-infrared sensors.

2. The automatic shoe cover stripping system of claim 1, wherein the electromechanical subsystem is energized by an AC motor or a DC servomotor that is controlled by the commands from the MCU via a control circuitry and electronic hardware associated with the MCU.

3. The automatic shoe cover stripping system of claim 1, wherein the shoe cover stripping module performs shoe cover stripping functions via a suctorial disk driven by a negative pressure, wherein said negative pressure is generated by a negative pressure generator and controlled by an electromagnetic valve.

4. The automatic shoe cover stripping system of claim 1, wherein said shoe cover removal module is to remove a shoe cover via a pair-roller and to dispose said shoe cover into said shoe cover collecting bin.

5. The automatic shoe cover stripping system of claim 1, wherein said shoe cover collecting bin is located at a lower position of said shoe cover stripping module for purposes of collecting the disposed shoe covers.

6. The automatic shoe cover stripping system of claim 1, wherein said disinfecting module sprays disinfectant on said disposed shoe covers to prevent contamination or cross contamination that is hazardous to human beings or animals.

7. The automatic shoe cover stripping system of claim 1, further comprising means for displaying and/or announcing a quantity of the shoe covers that have passed said shoe cover stripping system in real time and relaying data of said quantity to the MCU.

8. The automatic shoe cover stripping system of claim 1, wherein said set of physical and biophysical sensors is capable of recognizing and accepting human commands including a voice, touch screen commands, or via a keypad.

9. The automatic shoe cover stripping system of claim 1, wherein the system comprises dual units that are capable of stripping the two shoe covers from two feet of a person sequentially or simultaneously.

* * * * *